US008826540B2

(12) United States Patent
Schlatter et al.

(10) Patent No.: US 8,826,540 B2
(45) Date of Patent: Sep. 9, 2014

(54) METHOD AND DEVICE FOR INFLUENCING THE CUT AND FUNCTIONAL FACE ON FINE-BLANKED FINISHED PARTS

(75) Inventors: Ukrich Schlatter, Lyss (CH); Andreas Delis, Lyss (CH)

(73) Assignee: Feintool Intellectual Property AG, Lyss (CH)

( * ) Notice: Subject to any disclaimer, the term of this patent is extended or adjusted under 35 U.S.C. 154(b) by 464 days.

(21) Appl. No.: 13/024,114

(22) Filed: Feb. 9, 2011

(65) Prior Publication Data

US 2011/0192028 A1 Aug. 11, 2011

(30) Foreign Application Priority Data

Feb. 10, 2010 (EP) ..... 10001351

(51) Int. Cl.
*B21D 53/28* (2006.01)

(52) U.S. Cl.
USPC ..... 29/893.35; 29/893; 29/893.34; 72/336

(58) Field of Classification Search
USPC ..... 29/893, 893.34, 893.35; 72/336
See application file for complete search history.

(56) References Cited

U.S. PATENT DOCUMENTS

| | | | | | |
|---|---|---|---|---|---|
| 4,362,078 | A | * | 12/1982 | Ohnishi et al. | 83/862 |
| 4,586,360 | A | * | 5/1986 | Jurgensmeyer et al. | 72/328 |
| 4,876,876 | A | * | 10/1989 | Ishida et al. | 72/348 |
| 5,247,862 | A | * | 9/1993 | Haack | 83/27 |
| 5,263,353 | A | * | 11/1993 | Bakermans et al. | 72/334 |
| 5,320,013 | A | * | 6/1994 | Nonami et al. | 83/25 |
| 5,732,587 | A | * | 3/1998 | Maeda et al. | 72/348 |
| 6,125,527 | A | * | 10/2000 | Sunaga et al. | 29/558 |
| 6,212,930 | B1 | * | 4/2001 | Skrabs et al. | 72/336 |

(Continued)

FOREIGN PATENT DOCUMENTS

| | | |
|---|---|---|
| CH | 665 367 | 5/1988 |
| EP | 1 815 922 | 8/2007 |
| EP | 2 036 631 | 3/2009 |
| WO | WO 98/04138 | 7/1997 |

*Primary Examiner* — Lee D Wilson
*Assistant Examiner* — Ruth G Hidalgo-Hernande
(74) *Attorney, Agent, or Firm* — Jordan and Hamburg LLP

(57) ABSTRACT

The invention relates to a method and a device for influencing the cut and functional face, especially the reduction, during fine blanking of a finished part, for example, a gear, cut out of a metal strip, wherein the metal strip is clamped during closure between an upper part at least comprising a cutting punch and guide plate for the cutting punch and a lower part at least comprising a die plate and ejector and in a first working stage a blank with reduction is cut out of the metal strip.

Figure 1:
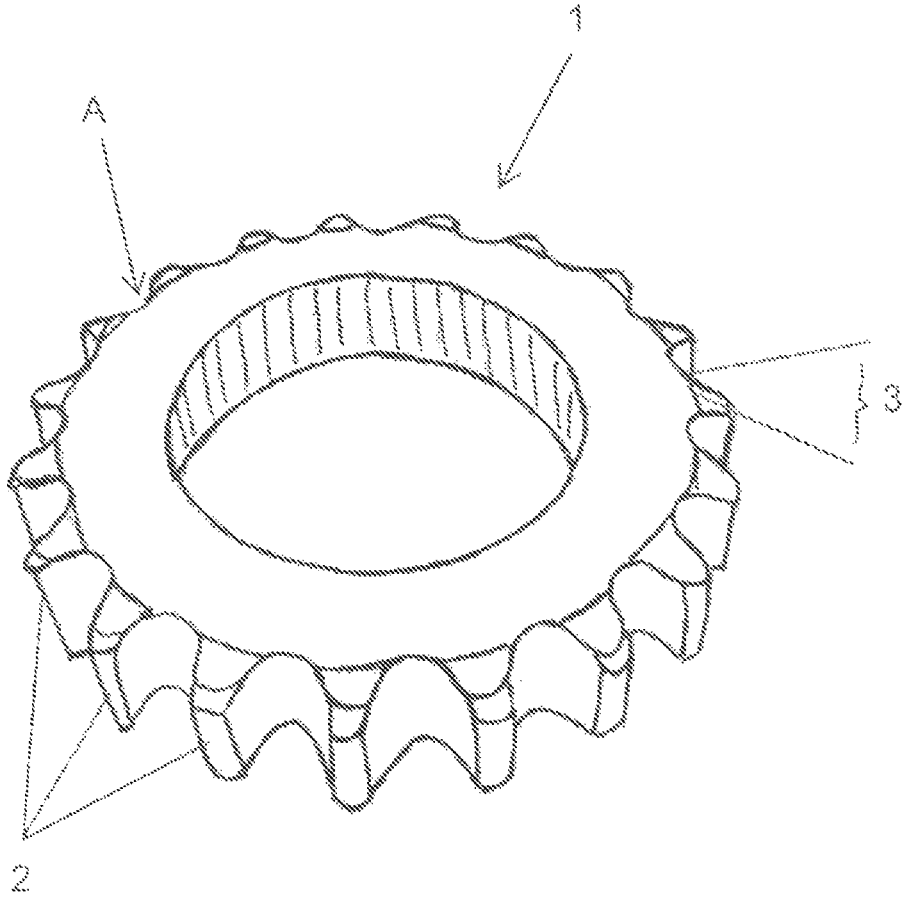

The invention has the task of providing a method and a device for purposefully influencing the cut and functional face, especially the reduction, during the production of finished parts, like gears, making it possible to purposefully influence or totally eliminate the edge reduction, while simultaneously maintaining the functional surfaces and saving material.

This task is solved by cutting out the blank with a defined material allowance relative to the contour of the finished part, at least in the area of the reduction, the size of which within the first working stage is adjusted to a stipulated degree to a material volume that fills up, compensates or exceeds the volume deficit occurring due to the reduction to a preset value and by subsequently during a second working stage shifting this material volume in a forming process opposite the cutting direction of the first working stage on the cutting line of the blank to purposefully fill up the developed reduction.

6 Claims, 9 Drawing Sheets

(56) References Cited

U.S. PATENT DOCUMENTS

| | | | | |
|---|---|---|---|---|
| 6,353,768 | B1 * | 3/2002 | Karafillis et al. | 700/97 |
| 7,194,388 | B2 * | 3/2007 | Chu et al. | 703/2 |
| 7,266,985 | B2 * | 9/2007 | Bello | 72/334 |
| 7,415,400 | B2 * | 8/2008 | Zhu et al. | 703/7 |
| 7,634,857 | B2 * | 12/2009 | Ueki et al. | 29/893.34 |
| 2008/0014036 | A1 * | 1/2008 | Ueki et al. | 409/1 |
| 2008/0053181 | A1 * | 3/2008 | Frauchiger | 72/336 |
| 2009/0010723 | A1 * | 1/2009 | Grimm | 407/116 |
| 2009/0090157 | A1 * | 4/2009 | Schlatter | 72/336 |
| 2009/0125138 | A1 * | 5/2009 | Muller et al. | 700/103 |
| 2009/0165525 | A1 * | 7/2009 | Schlatter et al. | 72/333 |
| 2009/0173129 | A1 * | 7/2009 | Marti et al. | 72/336 |

* cited by examiner

METHOD AND DEVICE FOR INFLUENCING THE CUT AND FUNCTIONAL FACE ON FINE-BLANKED FINISHED PARTS

This application claims foreign priority under 35 U.S.C. §119(a) from EP Application No. 10001351.5, filed on Feb. 10, 2010, the entirety of which is hereby fully incorporated by reference herein.

The invention relates to a method for influencing the cut and functional face, especially the reduction, on fine-blanked finished parts, for example, a gear or the like, cut out of a metal strip, wherein the metal strip is clamped during closure between an upper part at least comprising a cutting punch and guide plate for the cutting punch and a lower part at least comprising a die plate and ejector and in a first working stage a blank reduction is cut out of the metal strip with reduction.

The invention further relates to a device for influencing the cut and functional face, especially the reduction, in fine-blanked finished parts, for example a gear or the like, cut out of a metal strip with a tool consisting of two parts in the first processing step at least comprising a cutting punch, a guide plate for the cutting punch, an ejector and a die plate, wherein the metal strip during fine blanking of a blank is clamped between a guide plate and die plate.

PRIOR ART

Fine blanking and forming techniques are mainly used to process steels. The variety of materials used here extends from general-purpose construction steels to high-strength fine-grained steels. The resource "material" has been gaining increasing importance in recent years. With optimal material utilization the production costs of a component can be significantly influenced. The high-strength steels allow for components with thinner walls with the same strength behavior.

A typical feature of fine blanking parts is the edge reduction. Especially in corner areas the reduction occurs and increases with diminishing corner radius and increasing sheet thickness. The depth of the reduction can be about 20% and the width of the reduction can be about 30% of the sheet thickness or more (see DIN 3345, Feinschneiden, August 1980). Thus, the reduction depends on material thickness and quality, so that the possibility of controlling it is limited and often brings about restricted function of parts, for example, due to a lack of sharp edges of the corners on toothed parts or the change produced in the functional length of the parts.

The stamping reduction thus reduces the functionality of parts and forces the manufacturer to use a thicker raw material.

A large number of solutions are known that attempt to eliminate edge reduction either by re-cutting (CH 665 367 A5), shaving (DE 197 38 636 A1) or shifting of material during cutting (EP 1 815 922 A1).

The known solutions according to CH 665 367 A5 and DE 197 38 636 A1 do not reduce the edge reduction but largely rework the parts, so that, on the one hand, significant costs for additional machining operations and tools are required and, on the other hand, a respective loss of material occurs due to the necessity to use thicker material.

In the known solution according to EP 1 815 922 A1 the workpiece is machined in a single-step setup in at least two chronologically successive steps in different cutting directions, wherein during a first cutting process in a vertical working direction a semi-finished product is cut out corresponding to the geometry of the workpiece with small reduction and finally cut during at least one further cutting process in the opposite working direction. The reduction of the first partial step is to be filled up again at least in the corner area.

Furthermore, from EP 2 036 631 A1 a method is known for purposeful reduction of the edge reduction during fine blanking of a workpiece of a metal strip, wherein before cutting starts, negative preforming is carried out on the clamped untreated metal strip with a performing element in the direction opposite the cutting direction corresponding to the expected edge reduction during cutting into the die plate with respect to size and geometry including an allowance and creating a material volume in a mirror-image form on the side of the reduction. The preformed area of the clamped metal strip at the same time is supported by the preforming element.

The disadvantage of all these technical solutions is that the reduction occurring during fine blanking can only be reduced but not finally eliminated and not purposefully influenced.

TASK

With this prior art the invention has the task of providing a method and a device for purposefully influencing the cut and functional face, especially the reduction, during production of finished parts, like gears, making it possible to purposefully influence or totally eliminate the edge reduction, while at the same time maintaining the functional surfaces and saving material.

This task is solved by a method of the above-mentioned kind with the characterizing features of claim 1 and by a device with the characterizing features of claim 5.

Advantageous aspects of the method and the device can be deduced from the dependent claims.

The solution according to this invention proceeds from the finding to purposefully influence the reduction by a material allowance on the contour of a blank already before the fine blanking operation starts and to adjust its size to a desired dimension.

This is achieved by cutting out the blank with a defined material allowance with respect to the contour of the finished part, at least in the area of the reduction, the size of which within the first working stage is adjusted to a stipulated degree to a material volume that fills up, compensates or exceeds the volume deficit occurring due to the reduction and by subsequently during a second working stage shifting this material volume in a forming process opposite the cutting direction of the first working stage on the cutting line of the blank to fill up the developed reduction.

It is especially advantageous that the size of the material allowance with respect to the contour is defined as a function of the geometry of the finished part, the strength and the type of the material, the thickness of the finished part by means of a virtual fine blanking simulation and the size of the material volume to be shifted by means of a virtual forming simulation before fine blanking starts.

In a preferred aspect the method according to the invention is accomplished in the following steps:

a) Carrying out a fine blanking simulation in the area of the finished part that is to be influenced, and determining a virtual reduction, b) Determining the topography of the expected reduction resulting from step a) and the topography of a desired reduction on the finished part, c) Determining the lack of volume resulting from step b) to reach the desired net shape contour with respect to the reduction on the finished part, d) Determining a corrected contour for the respective area (nominal contour) resulting from steps a) to c) by adding a material allowance to compensate the missing b) volume in the area of the reduction, e) Carrying out a new virtual fine blanking of the corrected contour (nominal contour) and determining the topography of the developing reduction, f) Carrying out virtual forming of the fine-blanked, corrected contour with a forming die matching the net shape contour of the finished part and determining the developing corrected reduction, g) Repeating steps d) to f) until the desired reduction is reached, h) Designing die plate and cutting punch of the first working stage according to the corrected contour (nominal contour) of the blank found during steps a) to g).

The method according to this invention can be variably applied. It can be applied anywhere the reduction is to be compensated, for example, for production of sprockets, gears, gears for gear pumps, tooth segments or parts with functional corners.

Furthermore, the task is solved by a device, the tool of which in a second working stage comprises a punch and a die provided with an angular inclination facing the punch and having a net shape contour and an ejector, wherein the blank clamped between the punch and ejector and cut out with a material allowance is pushed back into the die, so that the material allowance is shifted on the cutting line of the fine-blanked blank to purposefully fill up the reduction.

In a further aspect of the device according to the invention the die has an angular inclination of about 8 to 15°, advantageously 10°, provided with a sharp transition to the vertical net shape contour.

The device according to the invention has a simple and robust structure and the great advantage that the first working stage (fine blanking) and the second working stage (forming) can be carried out within one tool.

Further advantages and details are apparent from the following description with reference to the attached drawings.

PRACTICAL EXAMPLE

The invention will be explained below in more detail by means of a practical example.

Figure 2:
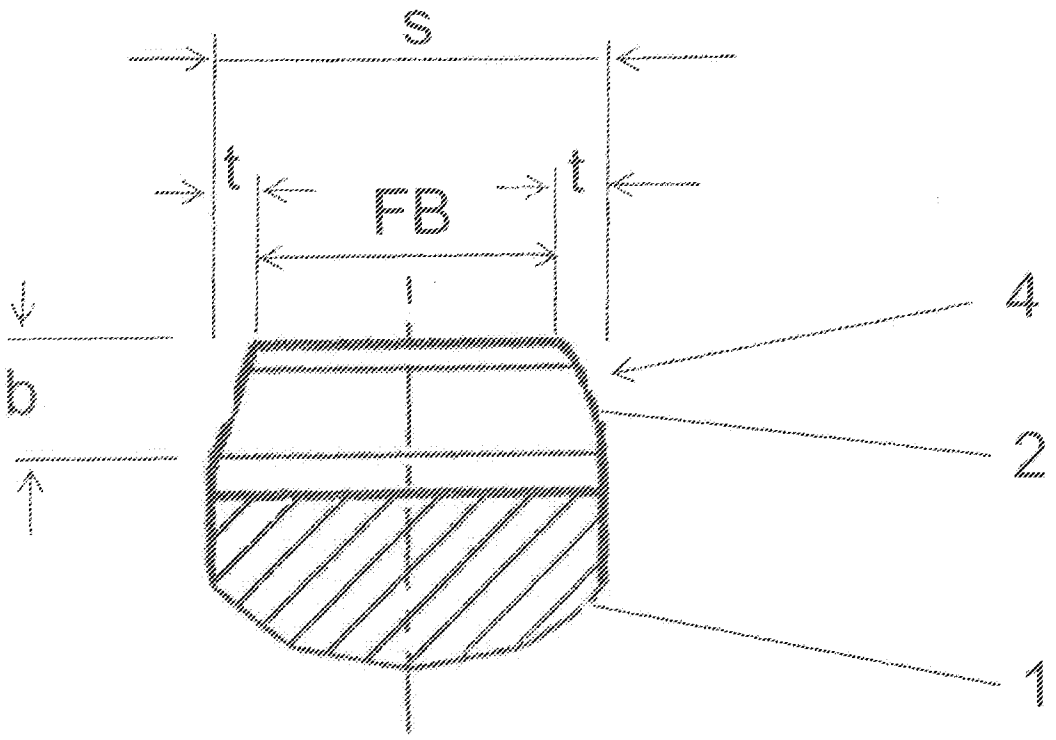
Figure 3:
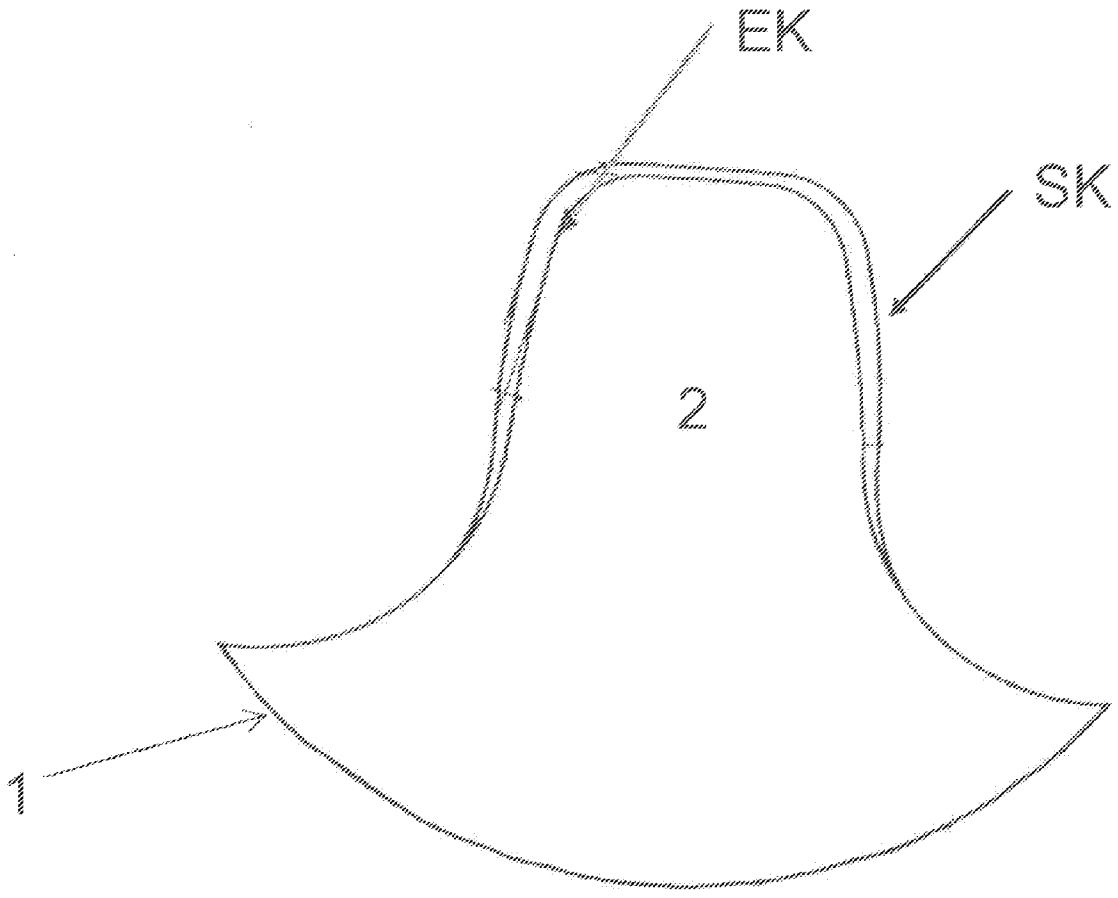
Figure 4:
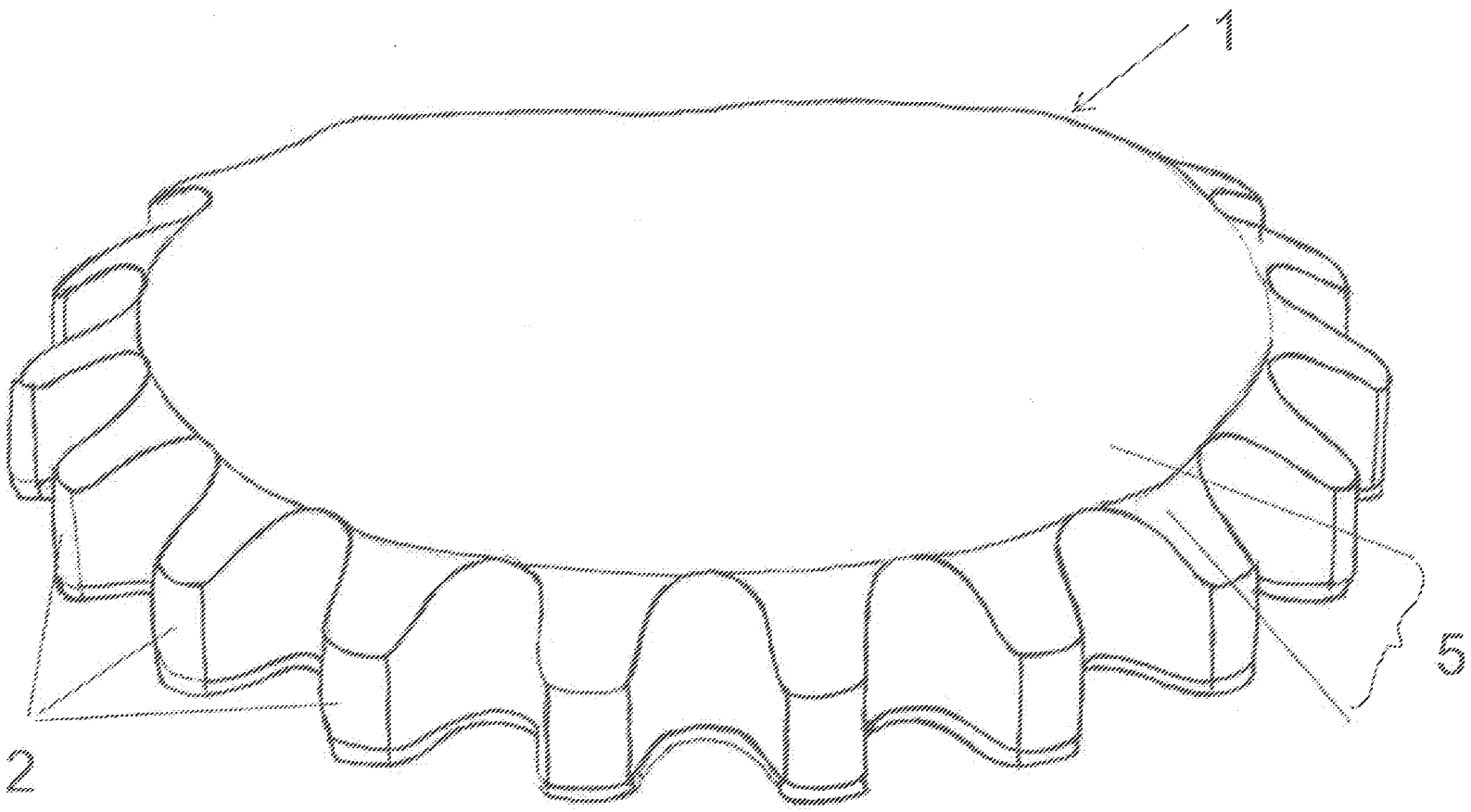
Figure 5:
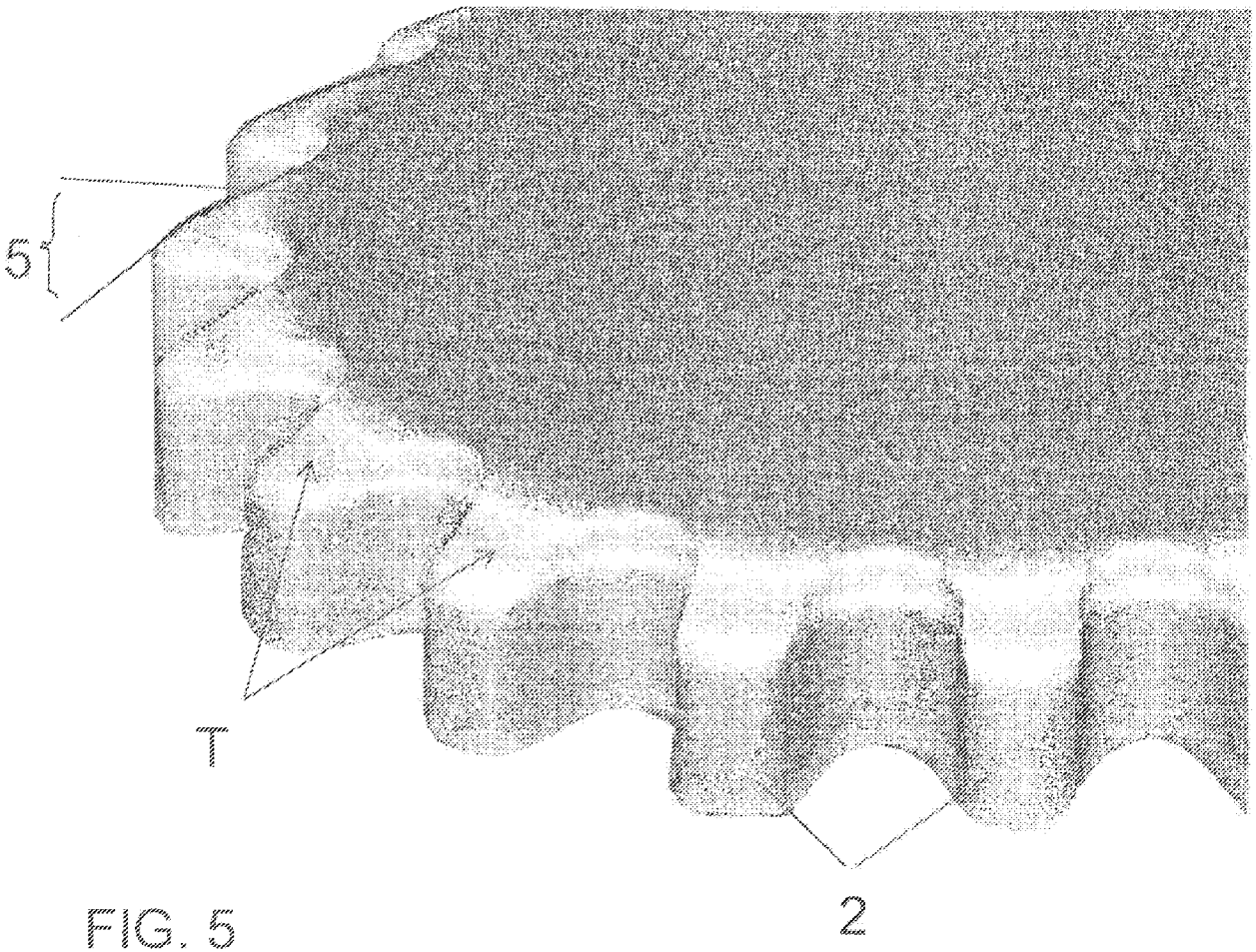
Figure 6:
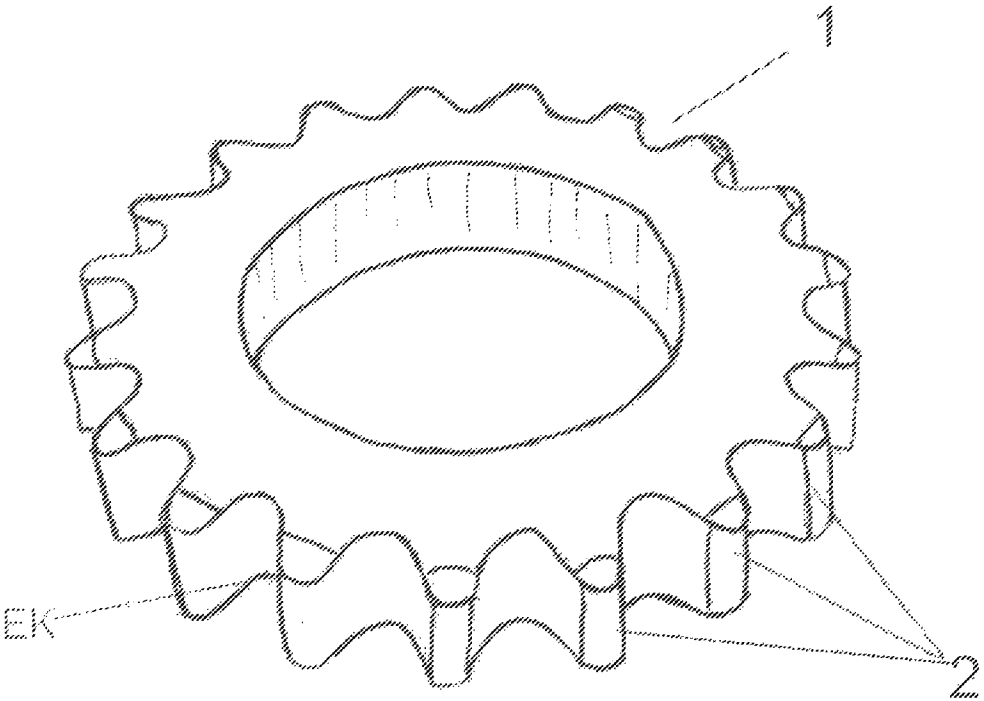
Figure 7:
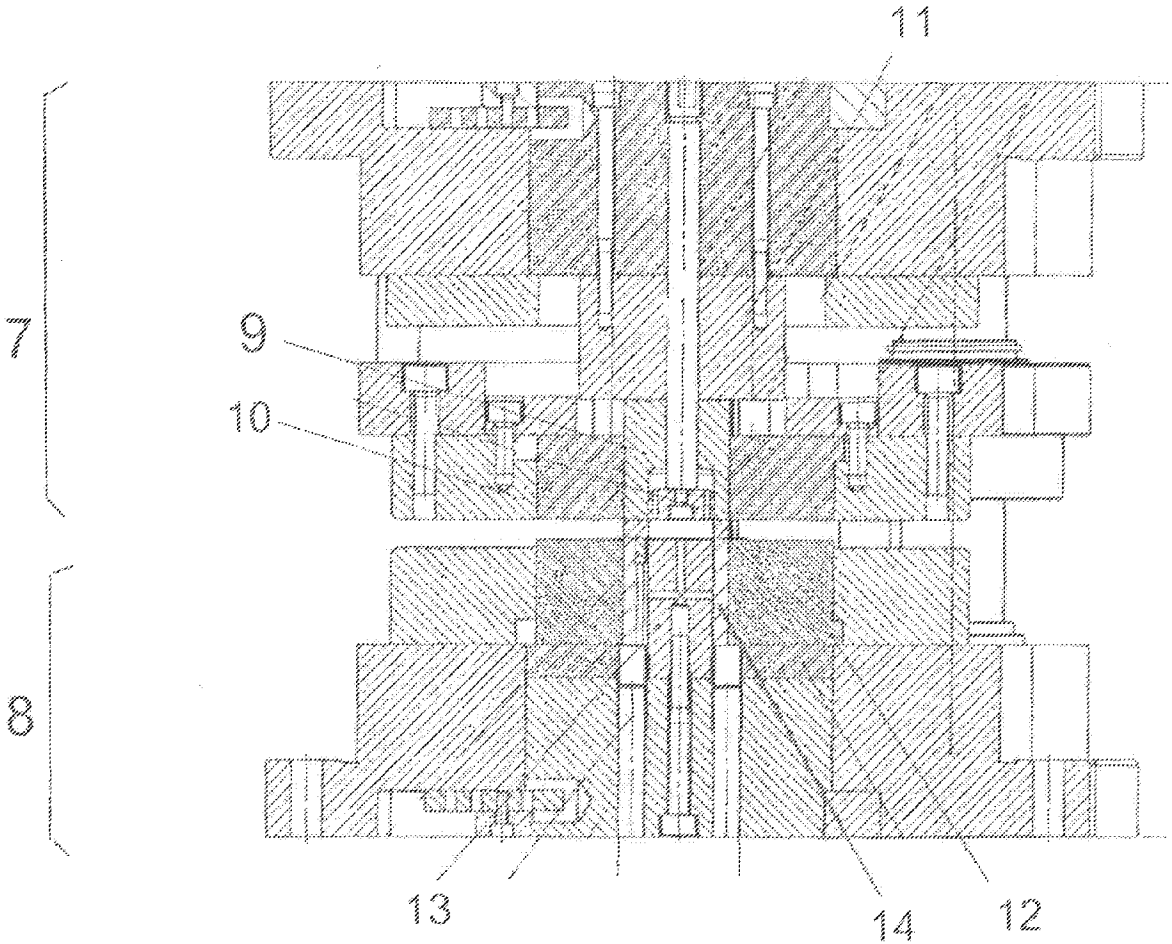
Figure 8:
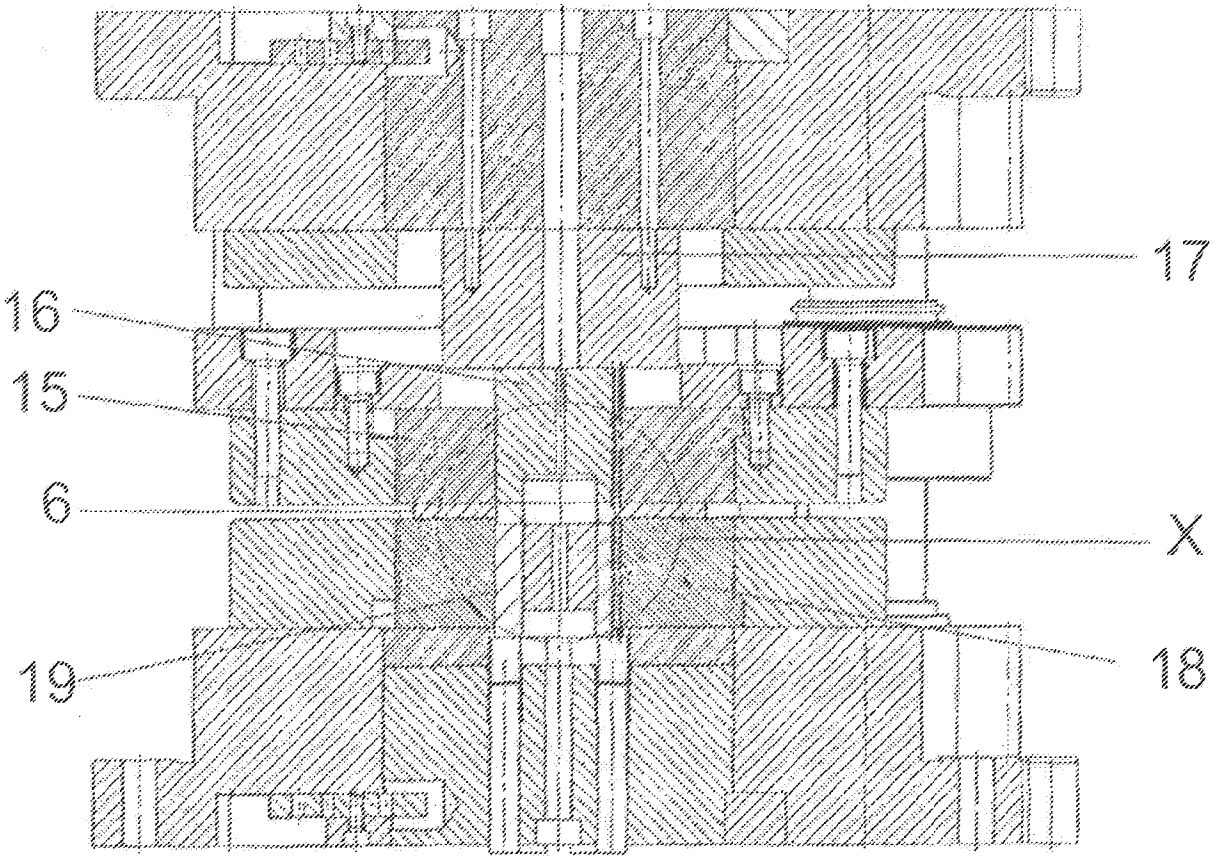
Figure 9:
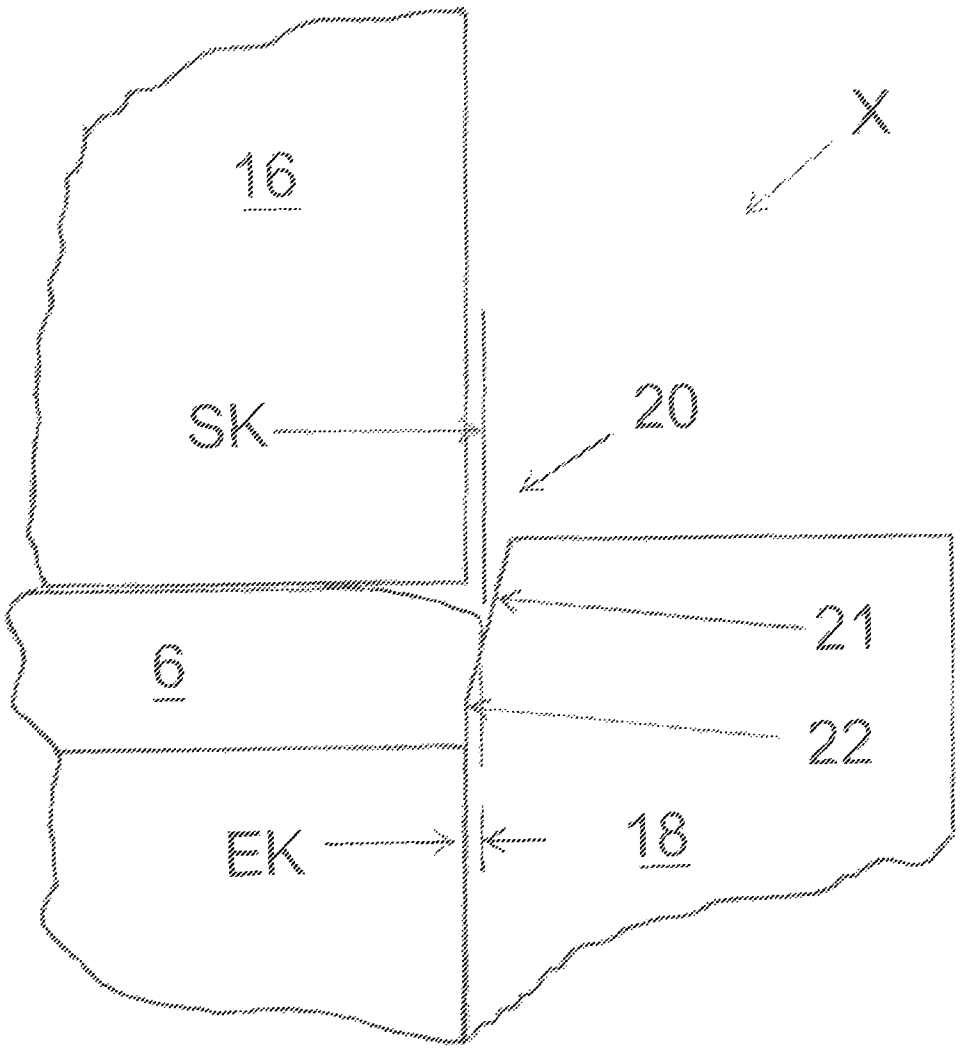

In the figures:

FIG. 1 shows the reduction side of a conventionally fine-blanked sprocket,

FIG. 2 shows a view of the geometrical proportions at a tooth of a sprocket with a desired punching reduction, FIG. 3 shows a schematic view of the net shape and the nominal contours on a tooth of the sprocket, FIG. 4 shows a schematic view of a virtually fine-blanked sprocket with the expected reduction, FIG. 5 shows a schematic view of the topography of the determined reduction, FIG. 6 shows a sprocket with sharp-edged teeth fine-blanked according to the method of this invention, FIG. 7 shows a sectional drawing of the first working stage, FIG. 8 shows a sectional drawing of the second working stage, FIG. 9 shows a detail X from FIG. 7 with an enlarged view of the die in the second working stage.

FIG. 1 shows a sprocket 1 from the side of the reduction A, which was produced by means of conventional fine blanking.

The reduction 3, which increases with diminishing corner radius and increasing sheet thickness, can be seen on the individual teeth 2 of sprocket 1. The reduction depth t can be about 20% and the reduction width b about 30% of the sheet thickness (see FIG. 2), functional surfaces on the teeth of the sprocket are significantly reduced and a thicker raw material has to be used to guarantee the function of the parts, for example, torque transfer.

By means of the method according to the invention this reduction 3 is to be variably controlled over a wide range, i.e., for a finished part a functionally predetermined reduction is to be achieved. In other words, the reduction on finished parts is to be adjustable in a range between normal values and zero (without reduction).

The sequence of the method according to the invention will be described below in more detail on the example of the sprocket 1 consisting of cold-extruded steel of the steel grade 16MnCr5/1.7131 with a material thickness s of 7 mm.

FIG. 2 shows the geometrical proportions of a desired reduction 4 on a tooth 2 of sprocket 1. The reduction depth t should be 0.8 mm and the reduction depth b should be 2.3 mm on both faces of the tooth. The functional width FB of the tooth should reach 5.4 mm.

The method according to the invention is initially achieved in several working steps, which are accomplished prior to the actual two-stage manufacturing process of the sprocket. In a first working step the expected reduction 5 is virtually determined in the case of conventional fine blanking in those areas of the sprocket 1 that are to be influenced. The result of this simulation is shown in FIG. 4.

The reduction can be defined as volume shrinkage on the finished part, i.e., the sprocket 1. Thus, in the second working step the missing volume necessary to reach a desired net shape contour of the sprocket can be determined with the desired reduction 4 and the expected reduction 5.

In the subsequent third working step the topography T of the expected reduction 5 and the topography of the desired reduction 4 are determined on the finished part (see FIG. 5) and from that in a fourth working step in the respective area of the sprocket 1 a nominal contour SK is determined by adding a certain material allowance, which fills up the missing volume in the area of the reduction (see FIG. 3). A blank 6 with the nominal contour SK is thus developed.

By virtual fine blanking of the corrected contour (nominal contour) again in a fifth working step the blank is prepared for virtual forming.

In the sixth working step the blank is then virtually formed and the developing reduction is examined. This is repeated until the desired reduction has been reached.

After these working steps are completed in the last working step, the cutting punch and the die plate can be designed for a first working stage to match the determined nominal contour SK of the blank 6 and the die to match the determined net shape contour EK of the finished part.

The actual production process of the sprocket 1 is accomplished in two working stages, which are combined in one tool, i.e., in a fine blanking stage and a subsequent forming stage.

This fine blanking differs from the conventional fine blanking in that a blank 6 at least in the reduction area is cut out to the net shape contour with a defined with respect to the finished part material allowance, the size of which is adjusted to a material volume, which to a predetermined extent fills up, compensates or exceeds the volume deficit caused by the reduction.

In the second working stage this material volume by a forming operation opposite the cutting direction of the first working stage is shifted on the cutting line of the blank to purposefully fill up the developed reduction, so that the desired reduction on the finished part is reached.

FIG. 6 shows this state on the finished part. It is apparent that the teeth are sharp-edged.

FIG. 7 shows the principle structure of the first working stage, comprising an upper part 7 and a lower part 8. The upper part 7 essentially comprises a cutting punch 9 guided on the guide plate 10 and a pressure plate 11 for the cutting punch 9. The lower part 8 consists of a die plate 12, a punch 13 and an ejector 14. The not shown metal strip of hardened steel with a thickness of 7 mm, from which sprocket 1 is to be produced according to the method of this invention, is, according to the shown working position of the tool, clamped between guide plate 10 and die plate 12.

FIG. 8 shows the second working stage, which is also divided into an upper part and a lower part. The upper part includes as main assemblies a guide plate 15, a punch 16 and a pressure plate 17 for the punch 16. The lower part essentially includes a die 18 and an ejector 19. The blank 6 cut out in the first working stage is clamped between punch 16 and ejector 19.

The cutting punch 9 and the die plate 12 are designed so that the blank 6 is cut out with the predetermined nominal contour SK, which is slightly larger relative to the net shape contour EK of the sprocket 1. This is especially significant for those areas, in which a large reduction is expected. The more the reduction is to be decreased, the larger the difference between the nominal contour SK and the net shape contour EK.

In the second working stage the blank 6, which is cut out slightly larger relative to the net shape contour EK by the punch 16, is pressed into the die 18. The die 18 has the net shape contour EK of the sprocket 1 (finished part). The die inlet 20 has an angular inclination 21 of about 10°, which grades into the vertical net shape contour EK with a sharp transition 22. This is shown in FIG. 9. It is apparent that, owing to material allowance projecting from blank 6, material is shifted with respect to height and thus partly or completely fills up the area of the reduction, or that in an extreme case in this area even overcompensation can be reached. That depends on the size of the added material allowance, so that the reduction on finished parts with corners, sharp transitions, teeth or the like according to their function respectively can be purposefully controlled or also completely compensated.

LIST OF REFERENCE SIGNS sprocket 1
teeth of 1 2
reduction on 2 3
desired reduction 4
expected reduction 5
blank 6
upper part 7
lower part 8
cutting punch 9
guide plate for 9 10
pressure plate for 9 11
die plate 12
punch 13
ejector 14
guide plate for 16 15
punch 16
pressure plate for 16 17
die 18
ejector 19
die inlet 20
angular inclination of 20 21
transition 22
reduction width
net shape contour EK
functional width FB
nominal contour SK
material thickness
reduction depth
topography

The invention claimed is:

1. A method for influencing a cut and functional face, including a reduction, of a fine-blanked finished part cut out of a metal strip, comprising:

clamping the strip during closure between an upper part and a lower part, the upper part comprising a cutting punch and guide plate for the cutting punch, the lower part comprising a die plate and an ejector, and wherein a blank with said reduction to a preset value is cut out of the metal strip during a first working stage by cutting in a cutting direction;

cutting the blank with a defined material allowance relative to a contour of the finished part at least in an area of the reduction;

wherein size of said area of reduction is adjusted within the first working stage to a stipulated degree to a material volume that fills up, compensates or exceeds a volume deficit that occurs due to the reduction to the preset value; and subsequent to the first working stage, during a second working stage during which a forming process is performed, shifting said material volume in a direction opposite the cutting direction of the first working stage on the cutting line of the blank to fill said reduction at least in part; and wherein a size of the material allowance relative to the contour is defined before actual fine blanking starts as a function of a geometry of the finished part, a strength and type of the material, and a thickness of the finished part by means of a virtual fine blanking simulation, and as a function of a size of the material volume to be shifted by means of a virtual forming simulation.

2. The method of claim 1, wherein a die with angular inclination is used to form the fine-blanked blank.

3. A method for influencing a cut and functional face, including a reduction, of a fine-blanked finished part cut out of a metal strip, comprising:

clamping the strip during closure between an upper part and a lower part, the upper part comprising a cutting punch and guide plate for the cutting punch, the lower part comprising a die plate and an ejector, and wherein a blank with said reduction to a preset value is cut out of the metal strip during a first working stage by cutting in a cutting direction;

cutting the blank with a defined material allowance relative to a contour of the finished part at least in an area of the reduction;

wherein size of said area of reduction is adjusted within the first working stage to a stipulated degree to a material volume that fills up, compensates or exceeds a volume deficit that occurs due to the reduction to the preset value; and subsequent to the first working stage, during a second working stage during which a forming process is performed, shifting said material volume in a direction opposite the cutting direction of the first working stage on the cutting line of the blank to fill said reduction at least in part; and further comprising the following steps:

a) performing a fine blanking simulation in the area of the finished part that is to be influenced, and determination of a virtual reduction, b) determining a topography of the expected reduction resulting from step a) and a topography of a desired reduction on the finished part, c) determining the missing volume resulting from step b) to reach the desired net shape contour relative to the reduction on the finished part, d) determining a corrected contour for the respective area (nominal contour) resulting from steps a) to c) by adding a material allowance to compensate the missing volume in the area of the reduction, e) carrying out a new virtual fine blanking of the corrected contour (nominal contour) and determining the topography of the developing reduction, f) carrying out virtual forming of the fine-blanked, corrected contour with a forming die matching the net shape contour of the finished part and determining the developing corrected reduction, g) repeating steps d) to f) until the desired reduction is reached, and h) designing the die plate and cutting punch of the first working stage according to the corrected contour (nominal contour) of the blank found during steps a) to g).

4. A method for influencing a cut and functional face, including a reduction, of a fine-blanked finished part cut out of a metal strip, comprising:

clamping the strip during closure between an upper part and a lower part, the upper part comprising a cutting punch and guide plate for the cutting punch, the lower part comprising a die plate and an ejector;

predetermining, for areas to be influenced during the cut, the reduction that is expected to occur during the cut;

determining, for said areas to be influenced during the cut, a difference between the reduction that is expected to occur and a desired reduction less than the expected reduction;

determining topography of the expected reduction and the desired reduction for said areas;

iteratively evaluating virtual cutting along different cutting contours to identify a nominal contour that includes a material allowance to the metal strip that compensates for the difference between the expected reduction and the desired reduction;

in a first working stage, performing said cut by cutting the blank by fine blanking along the identified nominal contour as defined for the material allowance to correct at least in part an infeed volume defect attributable to the cut; and subsequent to the first working stage, during a second working stage during which a forming process is performed, shifting said material volume in a direction opposite the cutting direction of the first working stage on the cutting line of the blank to fill said reduction to achieve said desired reduction in said areas to be influenced.

5. The method of claim 4, wherein a size of the material allowance relative to the identified nominal contour is defined before actual fine blanking starts as a function of a geometry of the finished part, a strength and type of the material of the metal strip, and a thickness of the finished part by means of a virtual fine blanking simulation, and as a function of a size of the material volume to be shifted by means of a virtual forming simulation.

6. The method of claim 4, further comprising the following steps:

a) performing a fine blanking simulation in the area of the finished part that is to be influenced, and determination of a virtual reduction, b) determining a topography of the expected reduction resulting from step a) and a topography of a desired reduction on the finished part, c) determining a missing volume resulting from step b) to reach the desired net shape contour relative to the reduction on the finished part, d) determining a corrected contour for the respective area (nominal contour) resulting from steps a) to c) by adding a material allowance to compensate the missing volume in the area of the reduction, e) carrying out a new virtual fine blanking of the corrected contour (nominal contour) and determining topography of the developing reduction, f) carrying out virtual forming of the fine-blanked, corrected contour with a forming die matching the net shape contour of the finished part and determining the developing corrected reduction, g) repeating steps d) to f) until the desired reduction is reached, and h) designing the die plate and cutting punch of the first working stage according to the corrected contour (nominal contour) of the blank found during steps a) to g).

* * * * *